US005683057A

United States Patent [19]

Gangemi

[11] Patent Number: 5,683,057

[45] Date of Patent: Nov. 4, 1997

[54] CORE CHUCK

[75] Inventor: Donald Gangemi, Great Barrington, Mass.

[73] Assignee: Beloit Technologies, Inc., Wilmington, Del.

[21] Appl. No.: 283,974

[22] Filed: Aug. 1, 1994

[51] Int. Cl.[6] ..... B65H 75/24; B23Q 3/00

[52] U.S. Cl. ..... 242/573.2; 242/573.8; 269/48.3

[58] Field of Search ..... 242/573.2, 573.7, 242/573.8; 269/48.3

[56] References Cited

U.S. PATENT DOCUMENTS

| | | | |
|---|---|---|---|
| 528,150 | 10/1894 | Coram | 242/573.2 |
| 718,700 | 1/1903 | Crosby et al. | 242/573.2 X |
| 1,668,990 | 5/1928 | Tromblay | 242/573.2 |
| 2,483,144 | 9/1949 | McConnell et al. | 242/72 |
| 2,594,095 | 4/1952 | Torregrossa et al. | 242/573.2 |
| 2,890,001 | 6/1959 | Triquet | 242/72 |
| 2,922,592 | 1/1960 | Kaltenbach | 242/68 |
| 2,942,892 | 6/1960 | Nelson | 279/2 |
| 3,085,763 | 4/1963 | Floyd, Jr. | 242/72 |
| 3,104,849 | 9/1963 | Bond | 242/72 |
| 3,298,627 | 1/1967 | Sturdy et al. | 242/72 |
| 3,306,550 | 2/1967 | Ewing | 242/68 |
| 3,355,121 | 11/1967 | Wright | 242/68 |
| 3,432,112 | 3/1969 | Le Hardy | 242/68 |
| 3,456,893 | 7/1969 | Michelson | 242/72 |
| 3,645,466 | 2/1972 | Karlson | 242/573.7 |
| 3,934,836 | 1/1976 | Dunlap et al. | 2442/573.7 |
| 4,079,896 | 3/1978 | Plach | 242/72 |
| 4,492,346 | 1/1985 | Young | 242/573.2 X |

FOREIGN PATENT DOCUMENTS

| | | | |
|---|---|---|---|
| 30 46 126 | 6/1982 | Germany . | |
| 62-175371 | 8/1987 | Japan | 242/573.7 |

*Primary Examiner*—John Q. Nguyen

*Attorney, Agent, or Firm*—Dirk J. Veneman; Raymond W. Campbell; Gerald A. Mathews

[57] ABSTRACT

An expandable mandrel including a threaded spindle with a drive for rotating the spindle, wedge pieces supported on the spindle with core chuck lugs facing outwardly for engaging the inner surface of a core, the wedge pieces having outwardly facing inclined cam surfaces, matching cam surfaces on the core chuck lugs to expand the core chuck lugs when the wedge pieces are moved relatively axially by the spindle, the wedge pieces and core chuck lugs being free to rotate with the spindle until locked by an annular gear and a stopping rack so that the wedge pieces and core chuck lugs are held against rotation to allow the spindle to rotate relatively thereby moving the wedge pieces axially and the core chuck lugs outwardly.

4 Claims, 4 Drawing Sheets

CORE CHUCK

BACKGROUND OF THE INVENTION

The present invention relates to improvements in the field of paper handling machines, and, more particularly, to an improved supporting mandrel structure for firmly holding the ends of a hollow core on which a continuous web is to be wrapped.

In winding endless webs of material such as paper onto and off of a core, it is necessary that the core be mounted concentrically with its axis of rotation in order to prevent tearing and twisting of the web. It is also necessary to prevent longitudinal movement of the core with respect to the material being reeled to prevent tearing or twisting of the material and to assure that the material being wound onto the core will have its edges aligned. The cores which are used are normally fiberboard having a rupture strength so that while the ends must be firmly gripped, they must not be gripped in such a manner to rupture the material. Also, the engagement must be such that it is firm and reliable and the engagement must not loosen during reeling operations. A further requirement is that the engagement between a supporting chuck arrangement and a core is that it can be completely and positively released.

Accordingly, it is an object of the invention to provide a core chuck apparatus which engage in the grips the inner surface of a core with a positive limit in engagement pressure to avoid damage to the core.

A further object of the invention is to provide a mechanical drive for a core chuck wherein a single drive is utilized for operatively engaging the core and the same drive is used for rotating the core after it has been gripped by the chuck.

A still further object of the invention is to provide an improved core chuck apparatus which is of simplified construction and completely reliable providing advantages over structures heretofore available.

FEATURES OF THE INVENTION

In accordance with the invention, a plurality of core chuck lugs are provided arranged circumferentially around a spindle with rotation of the spindle expanding the lugs easily and rapidly but terminating the expansion at a positive location so that nothing is left to chance insofar as the drive is concerned to endanger damaging the core. Yet, the expansion is such that the core is firmly gripped. This is accomplished by a plurality of wedge pieces driven axially by a spindle with the wedge pieces having inclined cam surfaces between them and the core chuck lugs. The spindle has positive stop limitations so that it can move the wedge pieces only so far. Also, a limitation is placed between the wedge pieces and core chuck lugs so that over radial expansion does not occur. A unique drive arrangement provides for the same drive to be utilized for the core gripping apparatus and the drive used for rotating the core.

Other objects, advantages and features, as well as equivalent structures and methods which are intended to be covered herein, will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
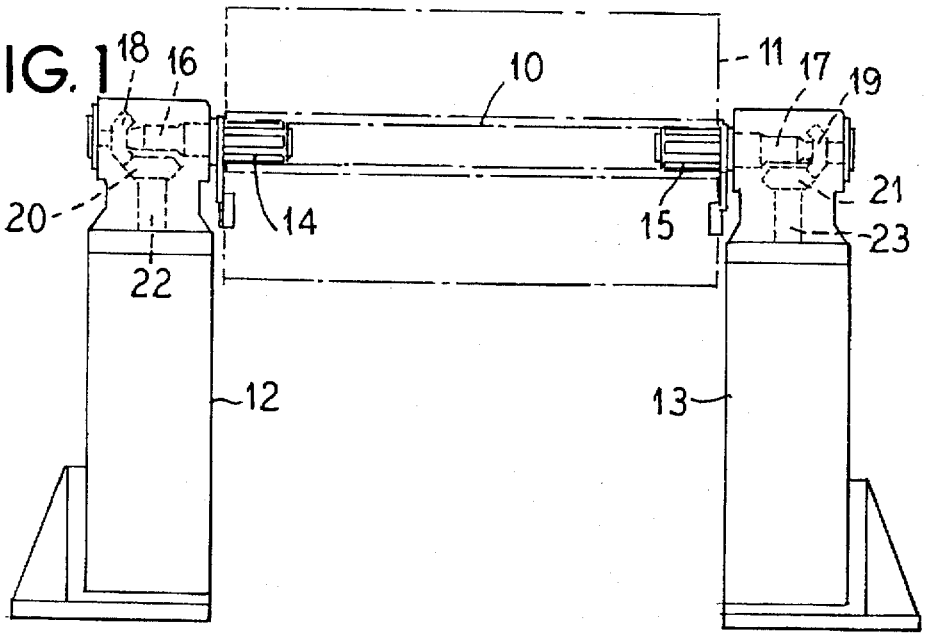
FIG. 1 is a front elevational view of a winding stand for supporting a core constructed with the principles of the present invention.
Figure 2:
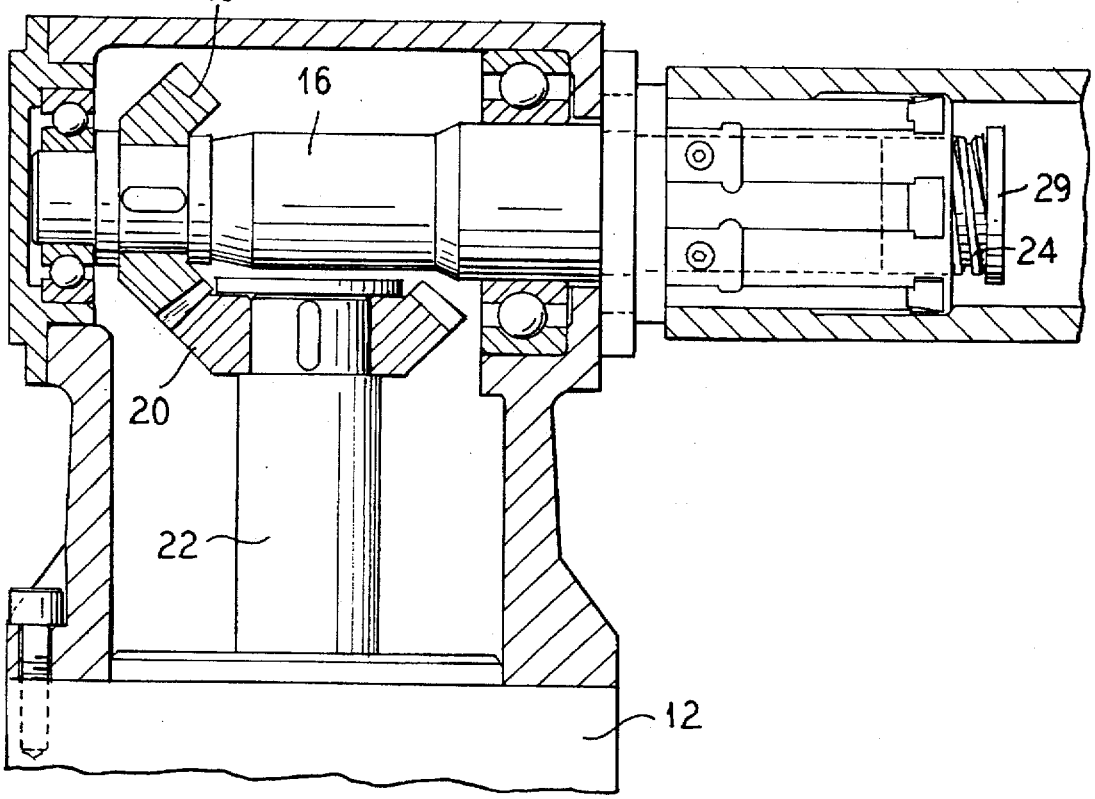
FIG. 2 is an enlarged vertical sectional view taken through the head of a winding stand.
Figure 4:
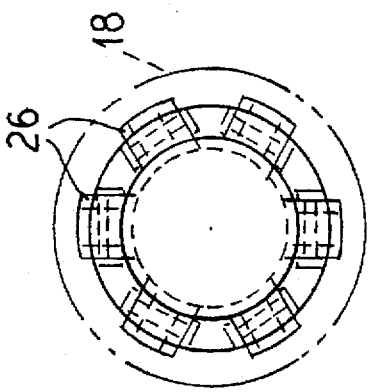
FIG. 4 is an end view of the core engaging mechanism of FIG. 3.

As illustrated in FIG. 1, a rotatable core 10 is supported for winding a continual web into a roll 11 shown in phantom form in FIG. 1. The core is supported by chucks 14 and 15 which are inserted into the ends of the core and have an expanding mechanism for pressure engaging the inner surface of the core 10 to support it. The core holding chucks are supported in end stands 12 and 13.

The core chucks are driven in rotation with a unique drive arrangement which functions not only to expand the core chucks to engage the inner surfaces of the core but also to rotate the core in driven rotation. This drive mechanism drives a core spindle 16 and 17 at each end with the spindle having a driven gear 18 and 19 driven by mating beveled gears 20 and 21 connected to drive shafts 22 and 23 which extend vertically up through the stands 12 and 13. Spindles 16,17 could be motor shafts.

Since each end of the apparatus supporting a core is identical, only one core chuck 14, and spindle 16, will be discussed with the understanding that the corresponding apparatus on the other end is the same in both structure and operation.

As illustrated in greater detail in FIGS. 5 and 7, the spindle shaft 16 is threaded with Acme-type threads at 24 at its outermost end to facilitate the transmission of axial force from the spindle through the expandable chuck mechanism to selectively engage and disengage the core as will be described in detail below. Spindle shaft 16 has a longitudinal axis 8.

Positioned encircling the outer periphery of cylindrical spindle 16 is a concentric hollow cylindrical collar 41, in the outer peripheral surface 47 of which are a plurality of wedge-shaped, axially extending recesses which are generally designated with the numeral 25. These wedge-shaped recesses have a pair of opposed, parallel side walls 31,31' and a pair of longitudinally aligned bottom cam surfaces 33,34. The first set of circumferentially disposed recesses 25 extend downwardly from the collar surface and axially inwardly from the outer, threaded end of spindle 16. The second set of circumferentially disposed recesses 25' begins axially inwardly, relative to the threaded outer end of the spindle, from near the ends of the corresponding first set of recesses 25. A shoulder 42, extending substantially radially relative to the outer surface of the collar, separates recesses 25,25' which otherwise comprise a substantially continuous recess. The width of the wedge-shaped recesses 25,25', as defined by side walls 31,31', corresponds, with suitable tolerances, to the width of a corresponding plurality of lugs 26 which are slidably disposed within the recesses 25,25'.

Figure 5:
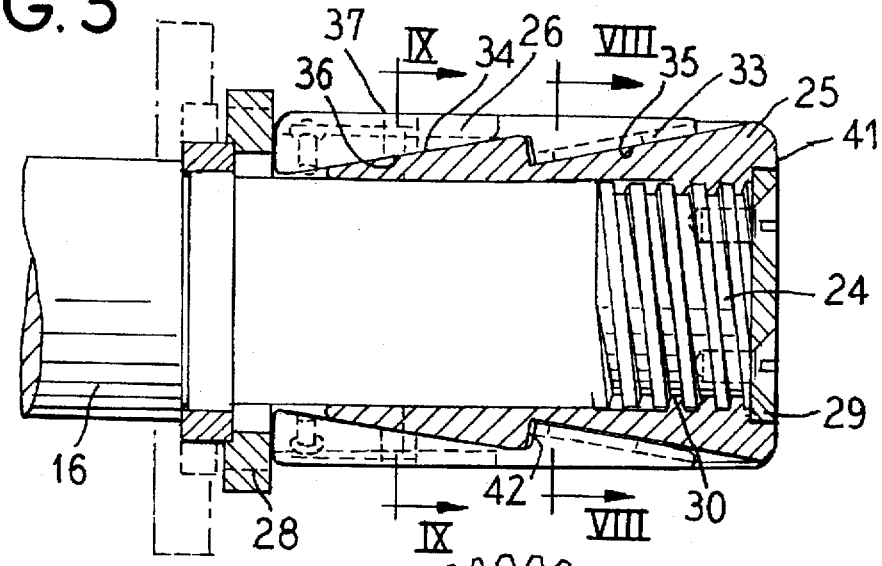
FIG. 5 is a vertical sectional view taken through the core engaging head.
Figure 6:
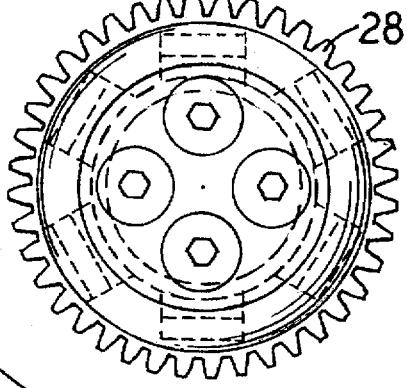
FIG. 6 is an end view of a holding gear.
Figure 7:
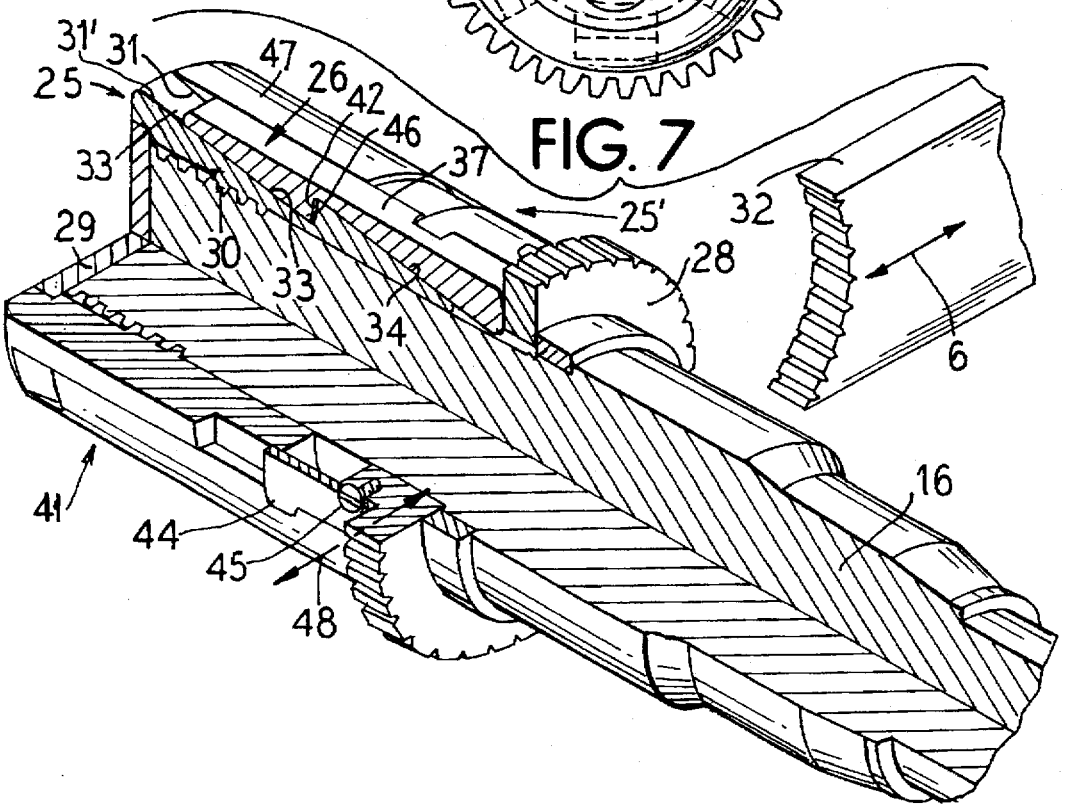
FIG. 7 is a perspective view of the core engaging mechanism with portions broken away.
Figure 10:
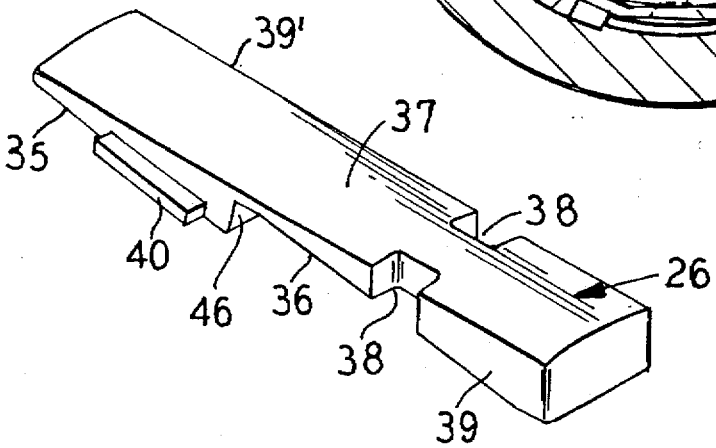
FIG. 10 is a perspective view of one of the core chuck lugs for engaging the inner surface of the core.

As shown in FIGS. 5, 7 and 10, each of the lugs 26 is shaped in the form of a pair of tandem, or end-aligned, wedges, which have a corresponding pair of cam surfaces 35,36 which are end-aligned and which are so constructed and arranged as to mate with corresponding cam surfaces 33,34, in sliding engagement therewith, in each recess 25,25' in the collar 41. Each of the lugs thus comprise a pair of end-aligned wedges having an outer surface 37, inner cam surfaces 35,36, and side surfaces 39,39'. The cam surfaces 35,36 are slanted relative to the outer surface 37.

The inner, cylindrical surface of collar 41 is also formed to have Acme threads 30 to engage the threads 24 on the spindle. A disk-shaped head 29 is attached to the end of the spindle 16 by screws, as shown in FIG. 5, and its outer periphery has a rim which engages a corresponding slot in the collar 41 to limit the axial outward movement of the collar relative to the outer, threaded end of spindle 16.

Figure 3:
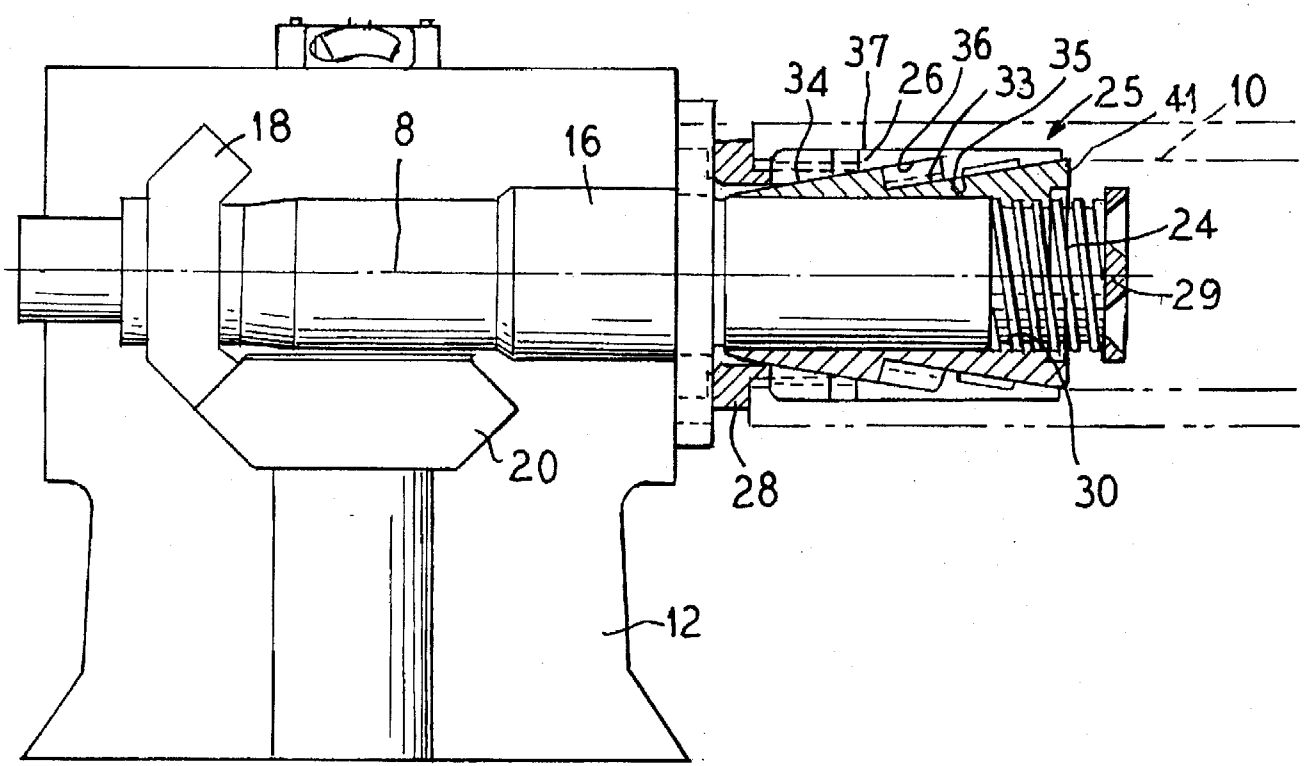
FIG. 3 is a fragmentary sectional view showing details of the core engaging mechanism.

In the view of FIG. 3, the lugs 26 have moved axially to the right relative to the collar 41, which causes these core chuck lugs to be forced radially outwardly to expand and engage the inner surface of the core 10 as their inner cam surfaces 35,36 slide over cam surfaces 33,34 on the collar 41. The lugs do not move axially relative to the core. The collar does not rotate, but moves axially relative to the spindle in a direction away from the threaded end of the spindle, which direction is toward the end of the core, or to the left as shown in FIG. 3.

In FIG. 5, the lugs 26 have moved to the left, relative to the collar, which permits the core chuck lugs to move radially inwardly and retract to a position where the core is released. As in all operation, such as described above in conjunction with FIG. 3, the lugs do not move axially relative to the core. The collar does not rotate, but moves axially relative to the spindle. All of this operation shown in FIGS. 3 and 5 is accomplished by rotating the collar 41 on the Acme threads to move the collar to the left in FIG. 3, and to the right in FIG. 5.

Axial movement of the collar 41 having the lugs 26 thereon is achieved by rotation of the spindle 16 relative to the collar via Acme threads 24,30. When the core chuck lugs are to be relaxed, rotation of the spindle moves the collar 41 axially outwardly toward the threaded end of the spindle until head 29 on the spindle seats against the collar 41 in the position shown in FIG. 5.

To cause the core chuck lugs to move radially outwardly and engage the core, the spindle is rotated in the opposite direction so that the threads 24 on the spindle interengaging with the threads 30 on the collar 41 will move the collar to the left in FIG. 3, or axially away from the threaded end of the spindle, and the cam surfaces 33,34 in the collar sliding axially along cam surfaces 35,36 on the lugs will cause the core chuck lugs to be forced radially outwardly to engage the core with their outer surface 37. This will only happen, however, if, as the spindle 16 is rotated, the collar 41 is held against rotation. If the collar 41 is allowed to rotate, the interaction between threads 24,30 will not move the collar because it will rotate with the spindle.

To lock the collar 41 to prevent its rotational movement so that the threads of the spindle move the collar co-axially with the longitudinal axis 8 of spindle 16, a gear ring 28 is provided, FIG. 7. This gear ring can be locked by a laterally (i.e. radially relative to the longitudinal axis 8 of spindle 16) moving toothed rack 32 which moves between engaged and disengaged positions in the direction of double headed arrow 6. As the rack 32 moves to the left in FIG. 7, it interengages with the teeth of the gear 28 to lock it. At that point, rotation of the spindle 16 in the appropriate direction will cause the collar 41 to be driven axially outwardly of the core 10, which is to the left in FIG. 3. This will cause the core chuck lugs 26 to climb in their individual grooves in the collar 41, climbing on the cam surfaces 33 and 34 in the collar 41.

When the core chuck is to be released, the spindle is locked by the rack 32 engaging the gear 28. The spindle rotates in a direction to move the collar 41 to the right as shown in FIG. 3 which permits the lugs to slide relative to the collar and move radially inwardly until the head 29 limits the collar movement. At this same time, co-acting shoulders 42, at the raised ends of the cam surfaces 34 on the collar 41, and shoulders 46, at the raised ends of lug surfaces 35 also limit the axial travel of the collar and radial travel of the core chuck lugs.

When a core has been gripped by the core chuck lugs being moved outwardly, the gear 28 is released by moving the rack out of engagement with the gear, and at that point the entire assembly of the collar and lugs rotates with the spindle so that no further axial travel of the collar, and radial movement of the core chuck lugs is encountered.

Figure 8:
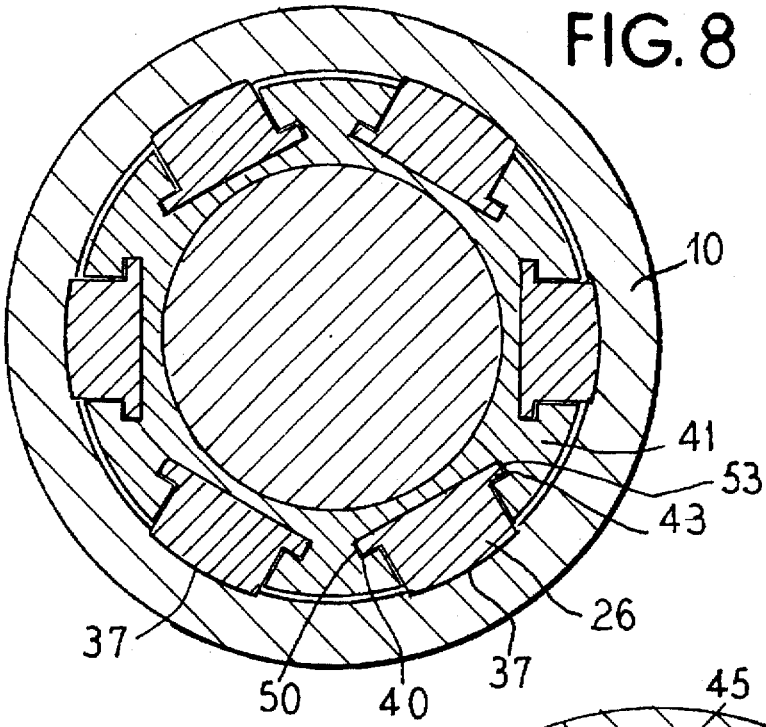
FIG. 8 is a sectional view taken substantially along line VIII—VIII of FIG. 5.

The core chuck lugs are held in their recesses 25 in the collar assembly by tongues 40 and 43 which extend laterally from opposite sides 39,39' of the lugs and into corresponding slots 50,53 in the collar 41. The tongues or projections 40 and 43 are shown both in FIGS. 8 and 10.

Figure 9:
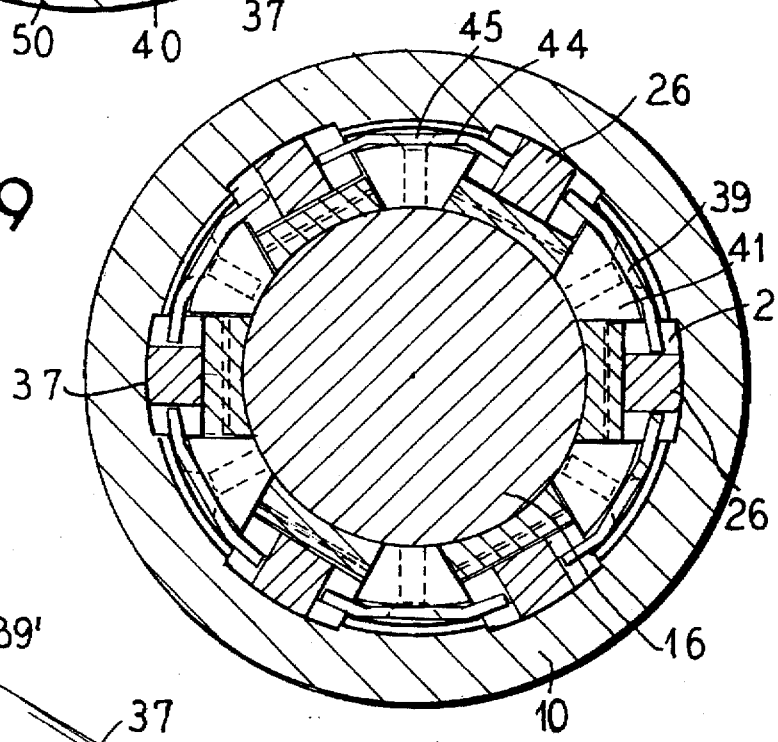
FIG. 9 is a sectional view taken substantially along line IX—IX of FIG. 5.

FIG. 9 illustrates additional retentive mechanisms for the lugs. For this purpose, the lugs have recesses 38 in the side into which project retaining fingers 44. These retaining fingers are held by suitable means such as a screw 45 in the collar 41. This is shown in FIGS. 7 and 9.

It is contemplated that in other constructions, separate wedge pieces may be employed held in place by suitable means to co-act with the chuck lugs.

With the double surfaces 33 and 34 in the collar acting on the corresponding cam surfaces 35,36 of the chuck lugs, the outer surfaces 37 of all the lugs will be kept parallel and will engage the cylindrical inner surface of the core for the entire length of each surface 37. That is, the outer surfaces which are slightly crowned to conform to the inner surface of a core, will extend parallel to the axis 8 of the spindle 16 in both the expanded position of the core chuck lugs and in the release position.

In operation, the core chucks will start with the lugs recessed in the position shown in FIGS. 5 and 7. A core will then be located in position concentrically about each of the chucks 14 and 15 (i.e. the chucks will be inserted into either end of a core) and for this purpose, the stands 12 and 13 or their heads can be spread to put a core 10 in position. The operator then locks the gear 28 by moving the rack 32, FIG. 7, into interengagement therewith, and rotates the spindle in a first direction. This moves the collar 41 inwardly from the threaded end of spindle 16, which is to the left in FIG. 5 and to the right in FIG. 7. This will cause the core chuck lugs 26 to be forced radially outwardly since their base abuts the inner surface of the gear 28 and they cannot shift axially as the cam surfaces 33,34 in the collar recesses co-act and slide over corresponding cam surfaces 35,36 on the lugs. The collar 41 can move only a limited distance thereby limiting the maximum radial outward expansion of the lugs 26 and the concomitant force they exert against the inner wall of the core. This limits the torque which can be applied. The gear 28 is then released by rack 32 and the spindle drives the core in rotation to proceed through the completion of the winding program. When the core is finished being wound, the control motors are reversed to reverse the direction of rotation of the spindle 16, with the gear 28 locked by the rack 32, and the chucks are unlocked from the cores by reverse movement of the lugs in the collar recesses. The stations are then separated to release the roll.

Generally speaking, torque must be applied to the spindle to expand the chuck, and counter-torque must be applied to collapse the chuck. In operation, collapse of the chuck is prevented by the fact that the frictional force between the cam surfaces on the collar and lugs exceeds the force which would cause these surfaces to slide relative to one another when the wound paper roll on the core supported by the chucks is braked. Inertia is controlled by controlling the braking procedure so as to not exceed the torque which will collapse the chuck.

With reference to FIG. 7, other apparatus has been contemplated to selectively permit co-rotation of the spindle and collar, or rotation of the spindle relative to the collar, as desired. Such apparatus would take the place of the rack 32 operating in conjunction with the toothed gear ring 28.

For example, a screw could be radially located in the peripheral edge of gear ring 28. When the screw is advanced radially inwardly through the gear ring and into the spindle, the spindle and gear ring are locked together to maintain the chuck in an un-collapsed state. When the screw is withdrawn from engagement with the spindle, gear ring 28 can rotate relative to the spindle, and the lugs can be collapsed.

Another contemplated manner for selectively securing or releasing the gear from the spindle would be to have a pair of spring-biased shear pins mounted between gear ring 28 and spindle 16. The pins could be positioned with their interface at the surface of the spindle so as to permit the gear to be unlocked relative to the spindle. When the pins are moved such that a pin extends between the spindle and gear ring, they would be locked together.

Both the screw and spring-biased shear pin arrangements are illustrated schematically in FIG. 7 by double-headed arrow 48.

Spindle 16 can be motor driven; it can be wrench actuated; it can be locked to gear ring 28 and engaged, or disengaged, by toothed rack 32.

Thus, it will be seen that there has been provided an improved core chuck support and locking mechanism which meets the objectives and advantages above set forth and provides a simple yet very reliable arrangement which can be operated over a long period of time without necessitating attention or repair.

I claim as my invention:

1. An expandable mandrel for locking and supporting a tubular core comprising, in combination:

a spindle having a threaded distal end and having a longitudinal axis, the spindle arranged to be inserted into a tubular core co-axially therewith to rotatably support the core;

a collar disposed about the periphery of the spindle, co-axially therewith, the collar having an outer surface and a longitudinal bore therethrough with one end of the bore containing internal threads for engaging the threads on the spindle, whereby the collar can be moved axially and non-rotatably relative to the spindle by relative rotation between the spindle and collar on the mating threads;

a plurality of wedge-shaped recesses formed in the outer surface of the collar, said recesses each having a cam surface extending from the outer surface inwardly longitudinally of the collar at an angle to the longitudinal axis to end at a shoulder extending between the cam surface and the outer surface;

a plurality of wedge-shaped lugs, corresponding in number to the wedge-shaped recesses, disposed in the recesses, each lug having an outer cam surface for engaging the tubular core, each lug also having an inner cam surface for engaging the corresponding cam surface of the wedge-shaped recess in which the lug is disposed, each lug having a shoulder disposed at an angle with its cam surface for engaging a corresponding shoulder in the collar recess;

drive means operatively linked with the spindle for selectively rotating the spindle with the collar and lugs;

locking means arranged relative to the spindle and the collar so as to selectively engage and rotationally lock the collar to permit axial movement of the collar relative to the spindle so that the spindle can be selectively rotated relative to the collar;

whereby rotation of the spindle relative to the collar causes the collar to move axially relative to the spindle about the longitudinal axis of the spindle to cause the lugs to move along the cam surfaces of the wedge-shaped recesses to selectively move the outer cam surfaces of the lugs radially inwardly or radially outwardly, relative to the outer surface of the collar, to engage or disengage from the core according to the rotational direction of the spindle.

2. An expandable mandrel for locking and supporting a tubular core constructed in accordance with claim 1:

the collar includes slots in the recesses;

wherein said lugs include laterally extending tongues for extending into the slots to secure the lugs to the collar.

3. An expandable mandrel for locking and supporting a tubular core constructed in accordance with claim 1, wherein:

the locking means comprises a gear ring co-axially disposed about the collar, and a non-rotatable rack for selective translational movement for engaging the gear to lock the gear in place against rotational movement to prevent rotation of the collar;

finger means corresponding in number with the lugs and operatively linking the locking means and a corresponding lug to permit longitudinal movement of the lug relative to the collar while preventing rotational movement of the gear ring relative to the collar.

4. An expandable mandrel for locking and supporting a tubular core constructed in accordance with claim 1, further including:

a head mounted to the said distal end of the spindle for limiting axial movement of the collar relative to the threaded end of the spindle.

* * * * *